US009527700B2

(12) United States Patent
Gerber

(10) Patent No.: US 9,527,700 B2
(45) Date of Patent: Dec. 27, 2016

(54) NESTED SHEAVE ARRANGEMENT FOR A TELESCOPIC BOOM AND APPLICATIONS OF SAME

(71) Applicant: SANY America Inc., Peachtree City, GA (US)

(72) Inventor: Kyle Gerber, Peachtree City, GA (US)

(73) Assignee: SANY AMERICA INC., Peachtree City, GA (US)

( * ) Notice: Subject to any disclaimer, the term of this patent is extended or adjusted under 35 U.S.C. 154(b) by 0 days.

(21) Appl. No.: 14/504,176

(22) Filed: Oct. 1, 2014

(65) Prior Publication Data

US 2015/0239715 A1 Aug. 27, 2015

(30) Foreign Application Priority Data

Feb. 26, 2014 (CN) ..... 2014 2 0082742 U

(51) Int. Cl.
*B66C 23/70* (2006.01)
*B66C 23/687* (2006.01)

(52) U.S. Cl.
CPC ..... *B66C 23/701* (2013.01); *B66C 23/703* (2013.01)

(58) Field of Classification Search
CPC ..... B66C 23/04; B66C 23/62; B66C 23/64; B66C 23/70; B66C 23/701; B66C 23/703
See application file for complete search history.

(56) References Cited

U.S. PATENT DOCUMENTS 3,465,899 A * 9/1969 Plymale ..... B66C 23/703 212/350
3,469,712 A * 9/1969 Haulotte ..... B66C 23/703 212/264
4,166,542 A * 9/1979 Bryan, Jr. ..... B66C 23/703 212/231
4,498,370 A * 2/1985 Breeden ..... B66C 23/705 212/276

* cited by examiner

*Primary Examiner* — Sang Kim
*Assistant Examiner* — Juan Campos, Jr.
(74) *Attorney, Agent, or Firm* — Tim Tingkang Xia, Esq.; Locke Lord LLP

(57) ABSTRACT

In one aspect of the invention, a telescopic boom includes a plurality of boom sections, and a sheave assembly disposed between two adjacent boom sections. The sheave assembly includes two sheave assembly sets. Each sheave assembly set includes a plurality of sheaves having different diameters. The plurality of sheaves is arranged abreast along a lengthwise direction of the adjacent boom sections and the diameters of the plurality of sheaves increase successively along the lengthwise direction of the adjacent boom sections. Each sheave is wound with one or more cables. The invention also discloses engineering machinery having the telescopic boom.

9 Claims, 8 Drawing Sheets

NESTED SHEAVE ARRANGEMENT FOR A TELESCOPIC BOOM AND APPLICATIONS OF SAME

CROSS-REFERENCE TO RELATED APPLICATION

This application claims the priority to Chinese Patent Application No. 201420082742.9, filed Feb. 26, 2014 in the State Intellectual Property Office of P.R. China, which is hereby incorporated herein in its entirety by reference.

FIELD OF THE INVENTION

The present invention relates generally to a telescopic structure, and more particularly to a telescopic boom and an engineering machinery having the telescopic boom.

BACKGROUND OF THE INVENTION

The background description provided herein is for the purpose of generally presenting the context of the present invention. The subject matter discussed in the background of the invention section should not be assumed to be prior art merely as a result of its mention in the background of the invention section. Similarly, a problem mentioned in the background of the invention section or associated with the subject matter of the background of the invention section should not be assumed to have been previously recognized in the prior art. The subject matter in the background of the invention section merely represents different approaches, which in and of themselves may also be inventions. Work of the presently named inventors, to the extent it is described in the background of the invention section, as well as aspects of the description that may not otherwise qualify as prior art at the time of filing, are neither expressly nor impliedly admitted as prior art against the present invention.

A telescopic mechanism of a medium or small tonnage telescopic boom type crane is usually formed by a hydraulic cylinder and a cable row, and such a mechanism allows several boom sections to extend or retract synchronously. Usually, for a small tonnage telescopic boom crane, synchronous extension and retraction can be implemented by only using two strands of cables on two sides of a boom section of the telescopic boom, that is, only one cable sheave is needed on each side of the boom section, and the cable sheave is located inside the boom section. Moreover, because of specifications of the curvature diameter (in a cable application, the diameter of a sheave is about 15 to 20 times of the diameter of the cable), a cable with a large diameter requires a sheave with the large diameter corresponding to the cable, and therefore occupies larger internal space of the telescopic boom, causing an increase of structure dimensions of both outer boom section and inner boom section. The increase of the structure dimension of the section of the telescopic boom means increases of both product weights and production costs.

For a medium tonnage telescopic boom crane, a manner in which sheaves are disposed abreast is usually used. In this case, the sheave is provided with two or three cable slots, and cables are arranged abreast along a widthwise direction of a boom section. By using the telescopic structure with such design, load of the one single cable is evenly distributed among the multiple strands of cables to achieve the effect of reducing the size of the cables while the loading or breaking force remains the same, thereby reducing the radial dimension of the sheaves. However, because the cables are arranged horizontally side by side, it takes larger space in a widthwise direction of the section of the telescopic boom. In design of a crane boom, the size of a base telescopic boom is relatively fixed due to loading requirement, a platform width, and transportation dimension. However, when a few of boom sections is installed, especially when a fourth and a fifth boom sections are installed the width space becomes very limited, and may cause serious loss of the rigidity in the widthwise direction of the telescopic boom.

Therefore, a heretofore unaddressed need exists in the art to address the aforementioned deficiencies and inadequacies

SUMMARY OF THE INVENTION

Accordingly, the present invention provides a telescopic boom that requires fewer spaces in widthwise dimensions of boom sections and has a large loading capacity, and an engineering machinery having the telescopic boom.

In one aspect, the present invention relates to a telescopic boom. In one embodiment, the telescopic boom includes a plurality of boom sections and a sheave assembly is disposed between two adjacent boom sections. The sheave assembly comprises two sheave assembly sets. Each sheave assembly sets having a plurality of sheaves having different diameters, where the plurality of sheaves is arranged abreast along a lengthwise direction of the adjacent boom sections and the diameters of the plurality of sheaves increase successively along the lengthwise direction of the adjacent boom sections; and each sheave is wound with one or more cables.

In one embodiment, the plurality of sheaves in each sheave assembly set is arranged in a coplanar manner.

In one embodiment, each sheave has one or more slots around which the one or more cables wind.

In one embodiment, the one or more cables comprise cables in same diameter. In another embodiment, the one or more cables include cables in different diameters.

In one embodiment, diameter differences between any two adjacent sheaves in each sheave assembly set is not less than twice a diameter of the thickest cable among the one or more cables.

In one embodiment, diameter differences between any two adjacent sheaves in each sheave assembly set are not equal. In another embodiment, diameter differences between any two adjacent sheaves in each sheave assembly set are equal.

In one embodiment, the number of the sheaves in each sheave assembly set is three.

In another aspect, the present invention relates to an engineering machinery that includes a telescopic boom. The telescopic boom is the same as the foregoing telescopic boom.

In certain embodiments, the engineering machinery is a crane.

The present invention provides a telescopic boom. The telescopic boom, among other things, includes a sheave assembly having two sheave assembly sets. Each sheave assembly set has several sheaves of different diameters. In one embodiment, the sheaves of each sheave assembly set are arranged abreast along a lengthwise direction of a boom section such that the center lines of the sheaves are aligned collinearly along a straight line which is parallel to the lengthwise direction of the boom section. In another embodiment, the sheaves of each sheave assembly set are arranged abreast along the lengthwise direction of a boom section such that the center lines of the sheaves are not aligned along a straight line which is parallel to the lengthwise direction of the boom section. The diameters of the sheaves increase successively along the lengthwise direction of the boom section. In addition, each sheave is wound with one or more cables. Accordingly, the telescopic boom takes great advantage of lengthwise direction spaces between the boom sections, so that the number of cables can be increased by adding sheaves along the lengthwise direction of the boom sections. As such, a widthwise direction space between the boom sections occupied by the sheaves can be reduced, and particularly when all the sheaves are located on the same plane, the occupied widthwise direction space is only as thick as that of one sheave, thereby reducing the width dimension requirement of the telescopic boom. On the other hand, the number of cables can be adjusted according to the number of sheaves, thereby ensuring a loading capacity of the cables.

These and other aspects of the invention will become apparent from the following description of the preferred embodiment taken in conjunction with the following drawings, although variations and modifications therein may be effected without departing from the spirit and scope of the novel concepts of the invention.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
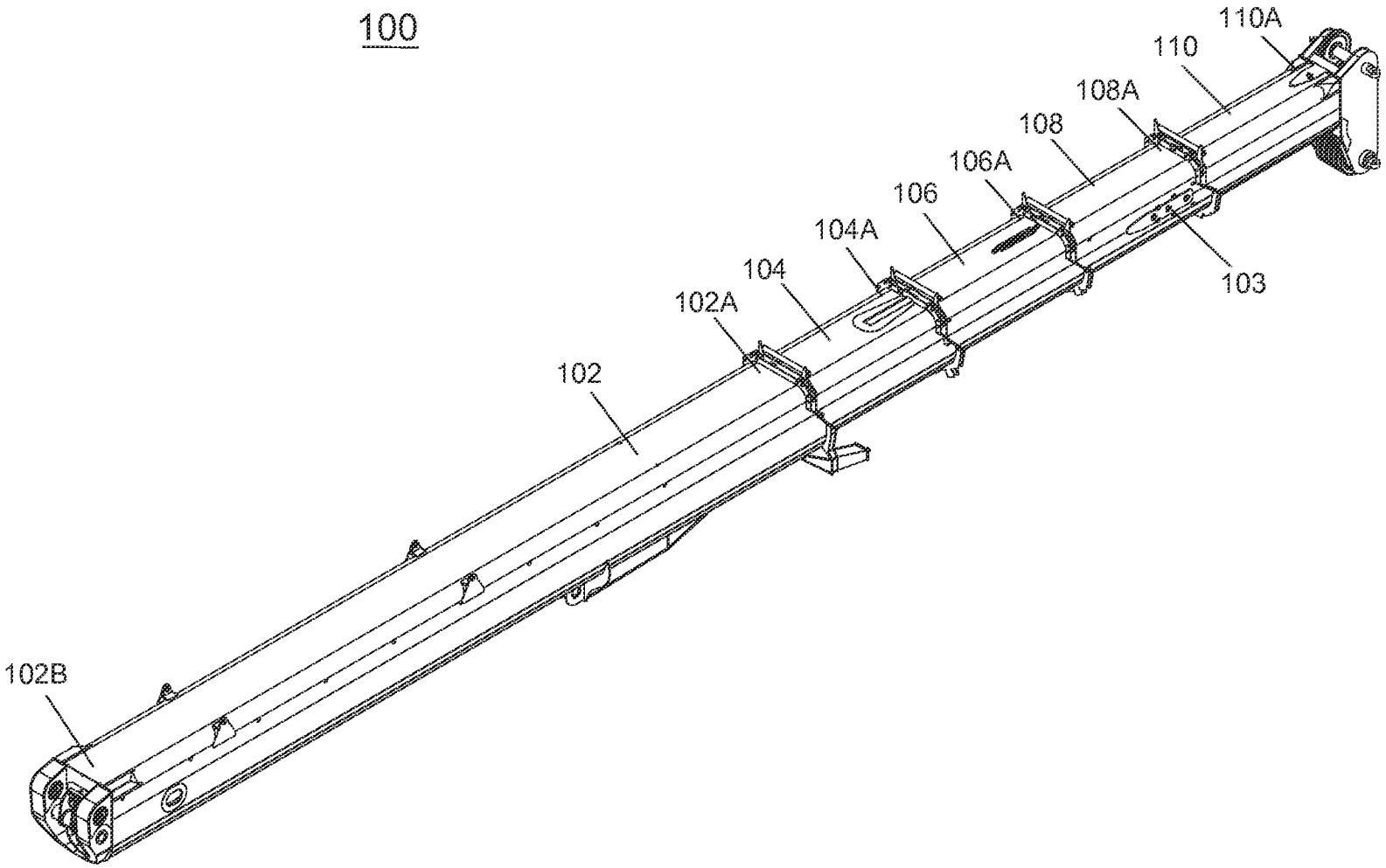
FIG. 1 schematically shows a perspective view of a telescopic boom according to one embodiment of the present invention.

The invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom", "upper" or "top," and "front" or "back" may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

The description will be made as to the embodiments of the invention in conjunction with the accompanying drawings in FIGS. 1-4. In accordance with the purposes of this invention, as embodied and broadly described herein, this invention, in certain aspects, relates to a telescopic boom, and an engineering machinery having the telescopic boom.

Referring to FIG. 1, a perspective view of a telescopic boom 100 is shown according to one embodiment of the present invention. The telescopic boom 100 includes five boom sections 102, 104, 106, 108 and 110. Each of the five boom sections 102, 104, 106, 108 and 110 has a head end (102A, 104A, 106A, 108A or 110A), and an opposite, tail end, where only the tail end 102B of the first boom section 102 is shown in FIG. 1. As assembled, the tail end of the fifth boom section 110 is placed inside of the fourth boom section 108. The tail end of the fourth boom section 108 is placed inside of the third boom section 106. The tail end of the third boom section 106 is placed inside of the second boom section 104. The tail end of the second boom section 104 is placed inside of the first boom section 102.

Figure 2:
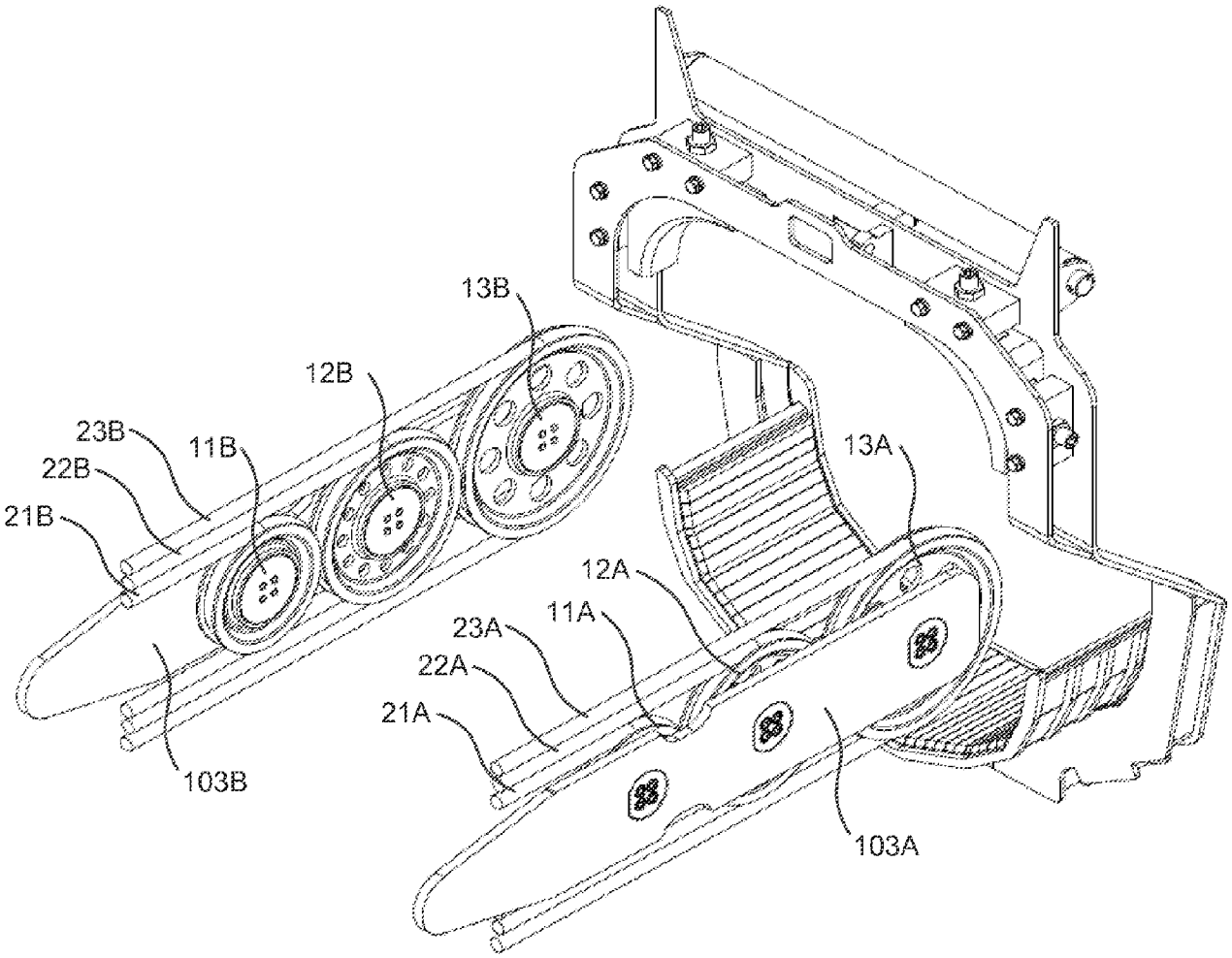
FIG. 2 schematically shows a partial perspective view of a sheave assembly disposed on a head end of a boom section between two adjacent boom sections of the telescopic boom as shown in FIG. 1.

In one embodiment, each of the five boom sections 102, 104, 106, 108 and 110 can be individually extended and retracted. In another embodiment, these five boom sections 102, 104, 106, 108 and 110 can be extended and refracted synchronously. The telescopic boom 100 also includes a sheave assembly 103. In this exemplary embodiment, the sheave assembly 103 includes two sheave assembly sets 103A and 103B, as shown in FIG. 2, and is placed in spaces between the fourth boom section 108 and the fifth boom section 110. Specifically, each sheave assembly set 103A or 103B is placed in a space defined between an outer sidewall of the fifth boom section 110 and a corresponding inner sidewall of the fourth boom section 108, and mounted on the corresponding inner sidewall of the fourth boom section 108.

FIG. 2 shows a partial perspective view of the sheave assembly 103 disposed on the head end 108A of the fourth boom section 108 of the telescopic boom 100. Each sheave assembly set 103A or 103B has several sheaves. In this exemplary embodiment, each sheave assembly set (103A or 103B) has a first sheave (11A or 11B), a second sheave (12A or 12B), and a third sheave (13A or 13B). The sheave assembly 103A has a first cable 21A winding over the first sheave 11A, a second cable 22A winding over the second sheave 12A, and a third cable 23A winding over the third sheave 13A. The sheave assembly 103B has a first cable 21 B winding over the first sheave 11B, a second cable 22B winding over the second sheave 12B, and a third cable 23B winding over the third sheave 13B.

In one embodiment, the cables 21A, 22A, 23A, 21B, 22B, and 23B are chosen to have the same diameter. In another embodiment, the cables 21A, 22A, 23A, 21B, 22B, and 23B are chosen to have different diameters.

Figure 3B:
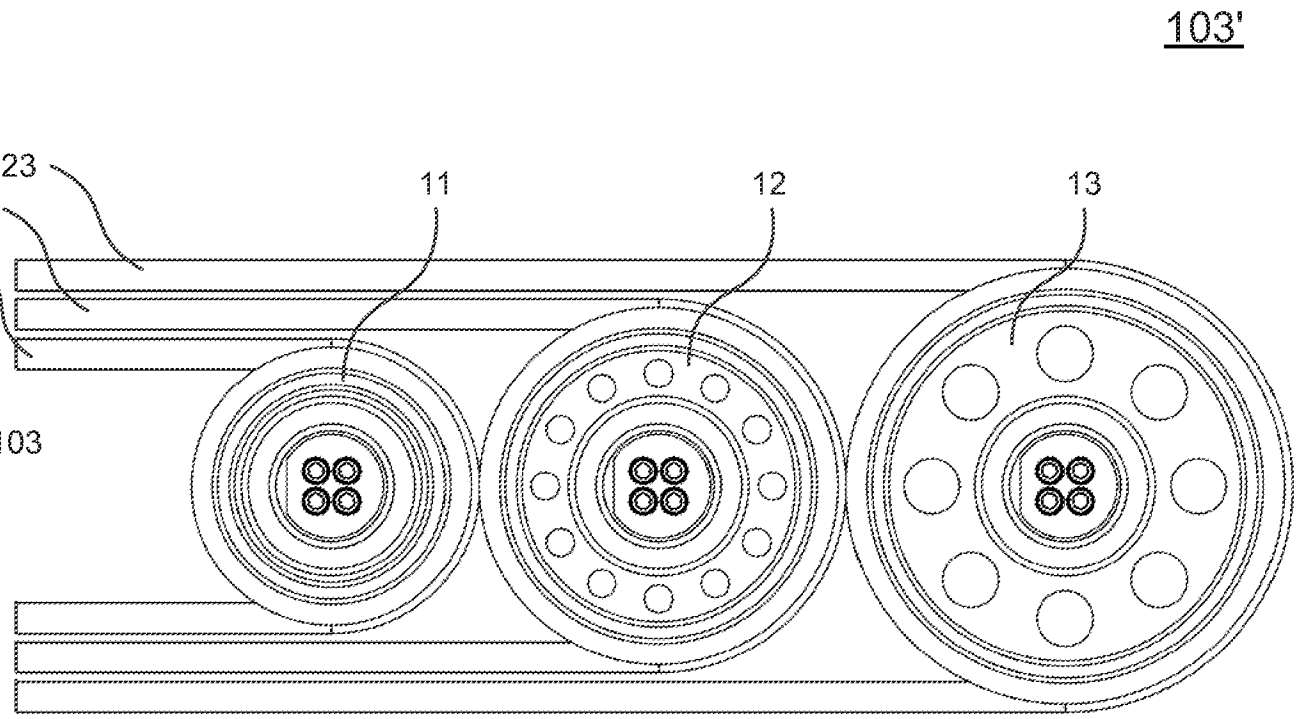
FIGS. 3A through 3C schematically show a rear view, a side view and a perspective view of a first embodiment of a sheave assembly, respectively, where center lines of the three sheaves are aligned in a single straight line which is parallel to a lengthwise direction of the second boom section according to certain embodiments of the present invention.
Figure 3A:
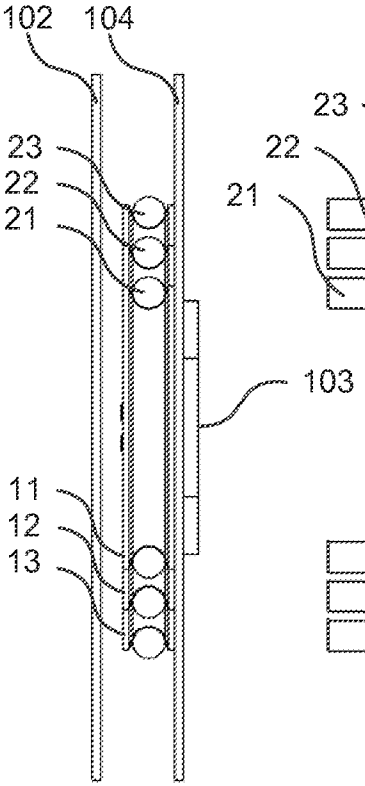
Figure 3C:
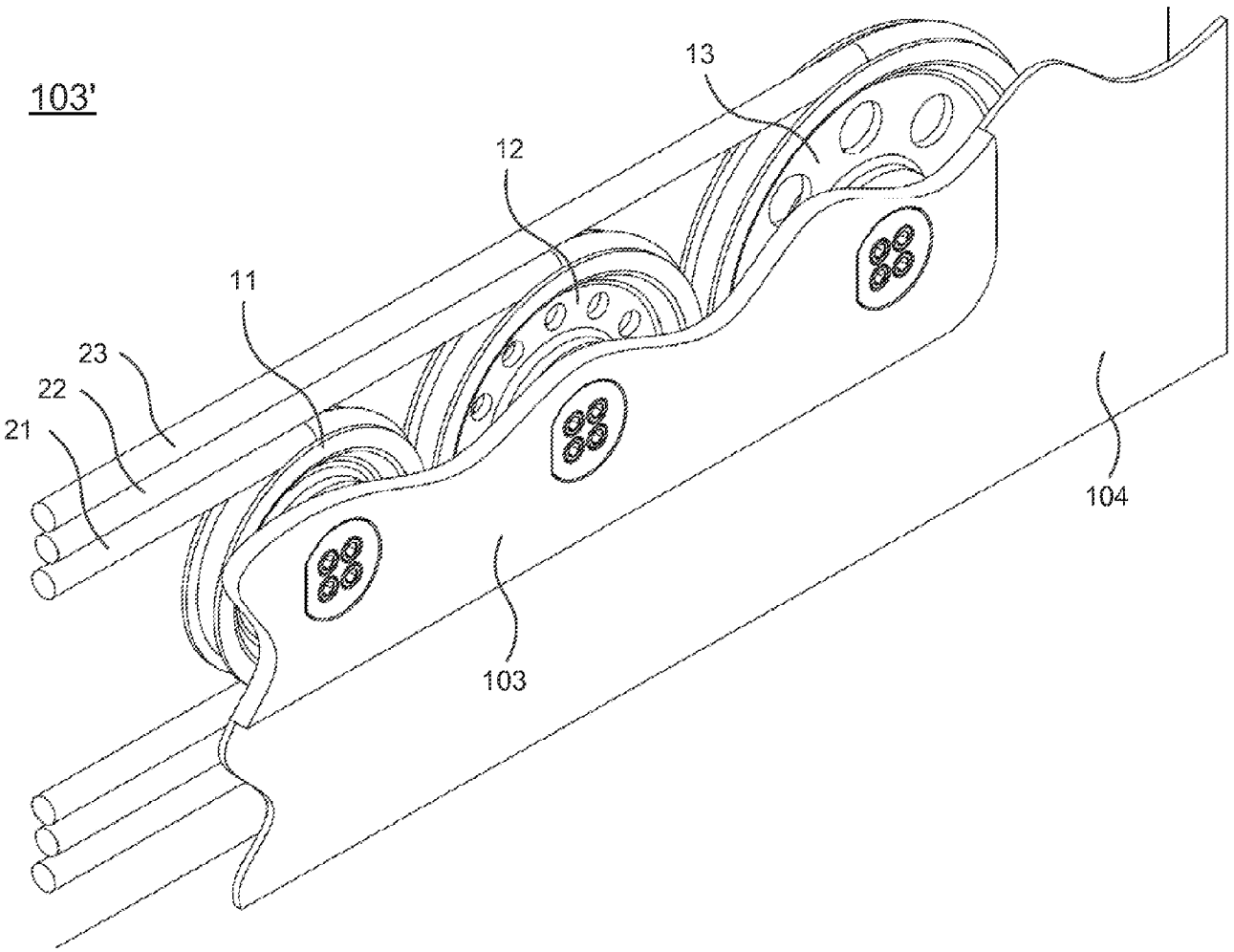

Referring now to FIGS. 3A-3C, a rear view, a side view and a partial perspective view of one of the two sheave assembly sets of the sheave assembly are respectively shown according to a first embodiment of the invention. The two sheave assembly sets of the sheave assembly are generally the same. For the simplicity of the description, only one sheave assembly set of the sheave assembly is illustrated and denoted with a reference numeral 103' hereinafter. In this embodiment, the sheave assembly set 103' has a first sheave 11, a second sheave 12, and a third sheave 13. The sheave assembly set 103' also has a first cable 21 winding over the first sheave 11, a second cable 22 winding over the second sheave 12, and a third cable 23 winding over the third sheave 13. As shown in FIG. 3A, the first sheave 11, the second sheave 12, and the third sheave 13 are arranged in a coplanar manner to minimize the space which these sheaves take in the widthwise direction. Therefore, the widthwise direction space which these three sheaves 11, 12 and 13 occupy is only as thick as one sheave, assuming these three sheaves have identical thickness. The sheaves 11, 12 and 13 used here may also be in different thickness. If these sheaves 11, 12 and 13 are in different thickness, the widthwise direction space which these three sheaves 11, 12 and 13 occupy is only as thick as the thickest one of these three sheaves 11, 12 and 13. This configuration saves the widthwise space between the two adjacent boom sections significantly.

In certain embodiments, in order to accommodate three sheaves 11, 12 and 13 in a coplanar manner, the diameters of the sheaves 11, 12 and 13 are different. As shown in FIGS. 3B and 3C, the diameters of the sheaves 11, 12 and 13 increase successively along the lengthwise direction of the boom section where the sheave assembly set 103' is installed. The sheave 11 has the smallest diameter. The sheave 13 has the largest diameter. The sheave 12 has the diameter between the smallest diameter and the largest diameter. In one embodiment, the diameter of the sheave 12 is the average of the smallest diameter and the largest diameter. In this case, the diameter differences between two adjacent sheaves in the sheave assembly set 103' are equal. In another embodiment, the diameter of the sheave 12 is chosen between the smallest diameter and the largest diameter. In this case, the diameter differences between two adjacent sheaves in the sheave assembly set 103' are not equal.

Figure 5:
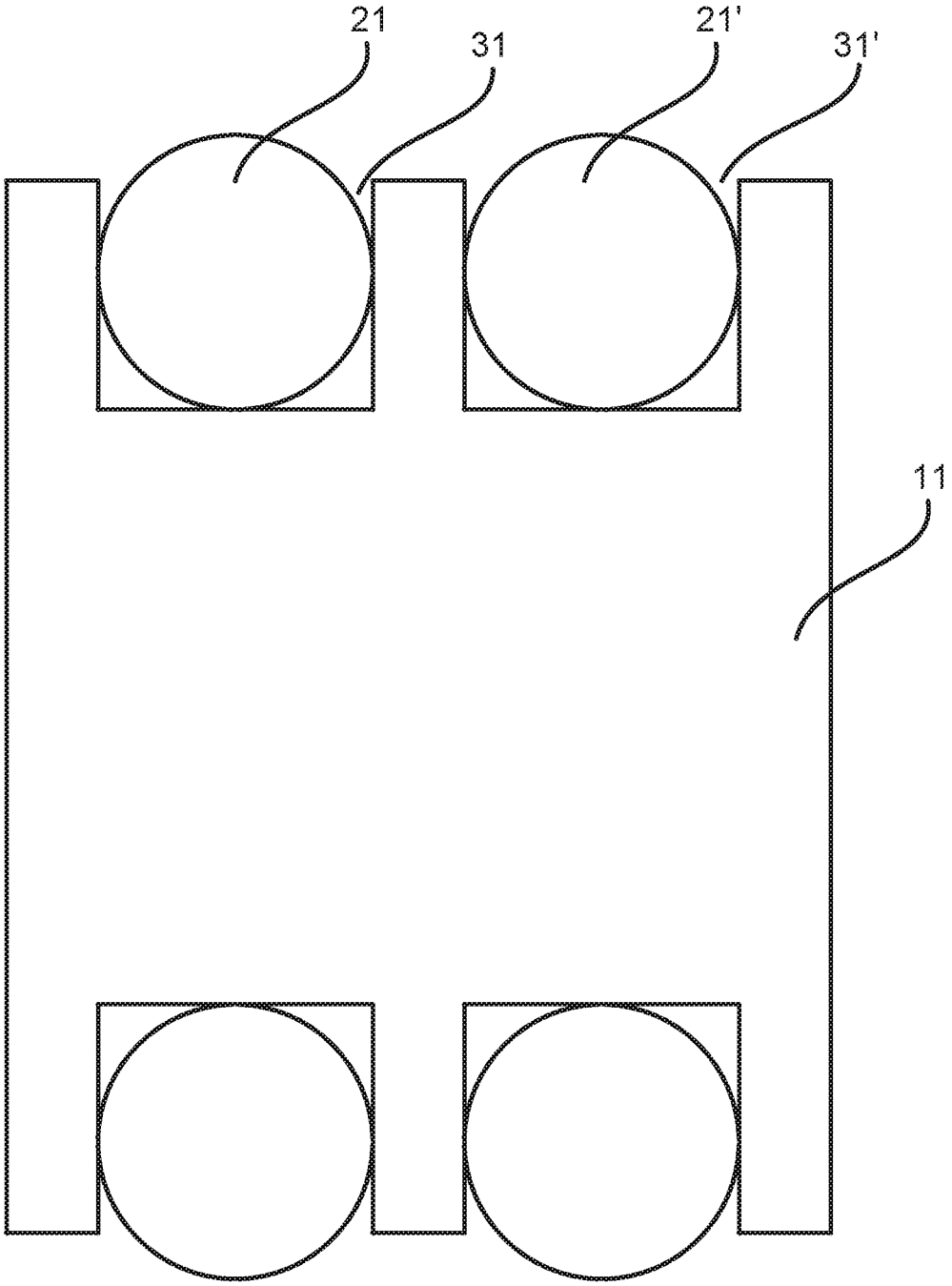
FIG. 5 schematically shows a sectional view of a sheave according to one embodiment of the present invention.

In one embodiment, each of the first sheave 11, the second sheave 12, and the third sheave 13 has one slot. In another embodiment, each of the first sheave 11, the second sheave 12, and the third sheave 13 can have more than one shot. In this case, each of the first sheave 11, the second sheave 12, and the third sheave 13 may have more than one cable to wind over these sheaves. FIG. 5 is a sectional view of a first sheave 11 according to one embodiment of the present invention. As shown in FIG. 5, the first sheave 11 has two slots 31 and 31', and two cables 21 and 21' are respectively wound over the slots 31 and 31'. In one embodiment, the first cables 21, the second cable 22, and the third cable 23 are chosen to have the same diameter. In another embodiment, each of the first cables 21, the second cable 22, and the third cable 23 is chosen to have different diameters. The diameters of the cables are chosen according to the design specification of the load capacity of the telescopic boom 100.

In one embodiment, the diameter differences between any two adjacent sheaves in the sheave assembly set 103' is not less than twice the diameter of the thickest cable among the first cable 21, the second cable 22 and the third cable 23.

In this exemplary embodiment shown in FIGS. 3A-3C, the first sheave 11, the second sheave 12, and the third sheave 13 are arranged such that the center lines of the first sheave 11, the second sheave 12, and the third sheave 13 are aligned in a single straight line parallel to the lengthwise direction of the fourth boom section 108. It should be appreciated by persons skilled in the art that other arrangements of the first sheave 11, the second sheave 12, and the third sheave 13 can also be utilized to practice the invention. For example, the center lines of the first sheave 11, the second sheave 12, and the third sheave 13 may not be aligned in a single straight line parallel to the lengthwise direction of the fourth boom section 108, as shown in FIGS. 4A-4C.

Figure 4B:
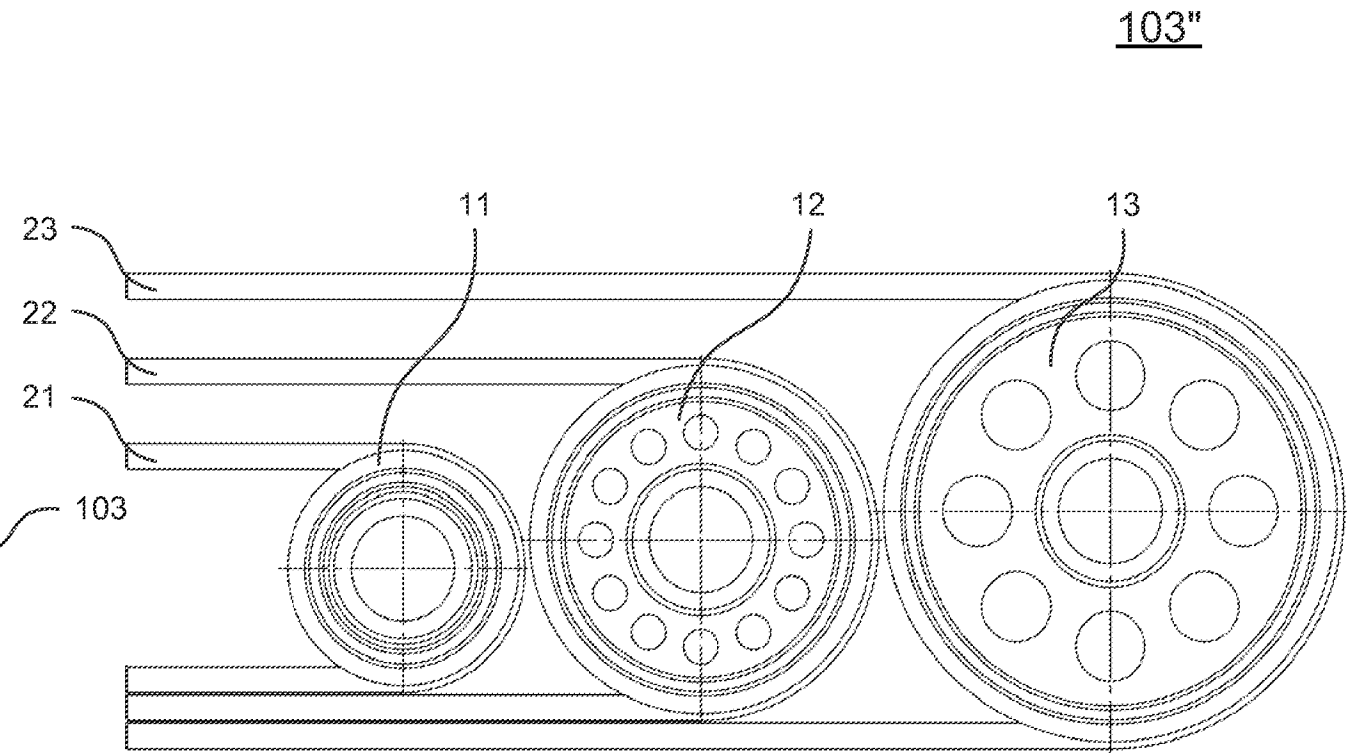
FIGS. 4A through 4C schematically show a rear view, a side view and a perspective view of a second embodiment of a sheave assembly, respectively, where center lines of the three sheaves are not aligned in a single straight line which is parallel to a lengthwise direction of the second boom section according to certain embodiments of the present invention.
Figure 4A:
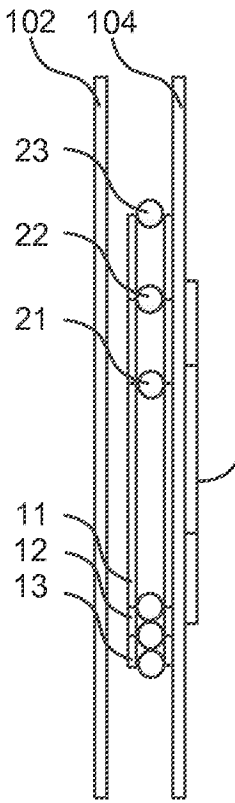
Figure 4C:
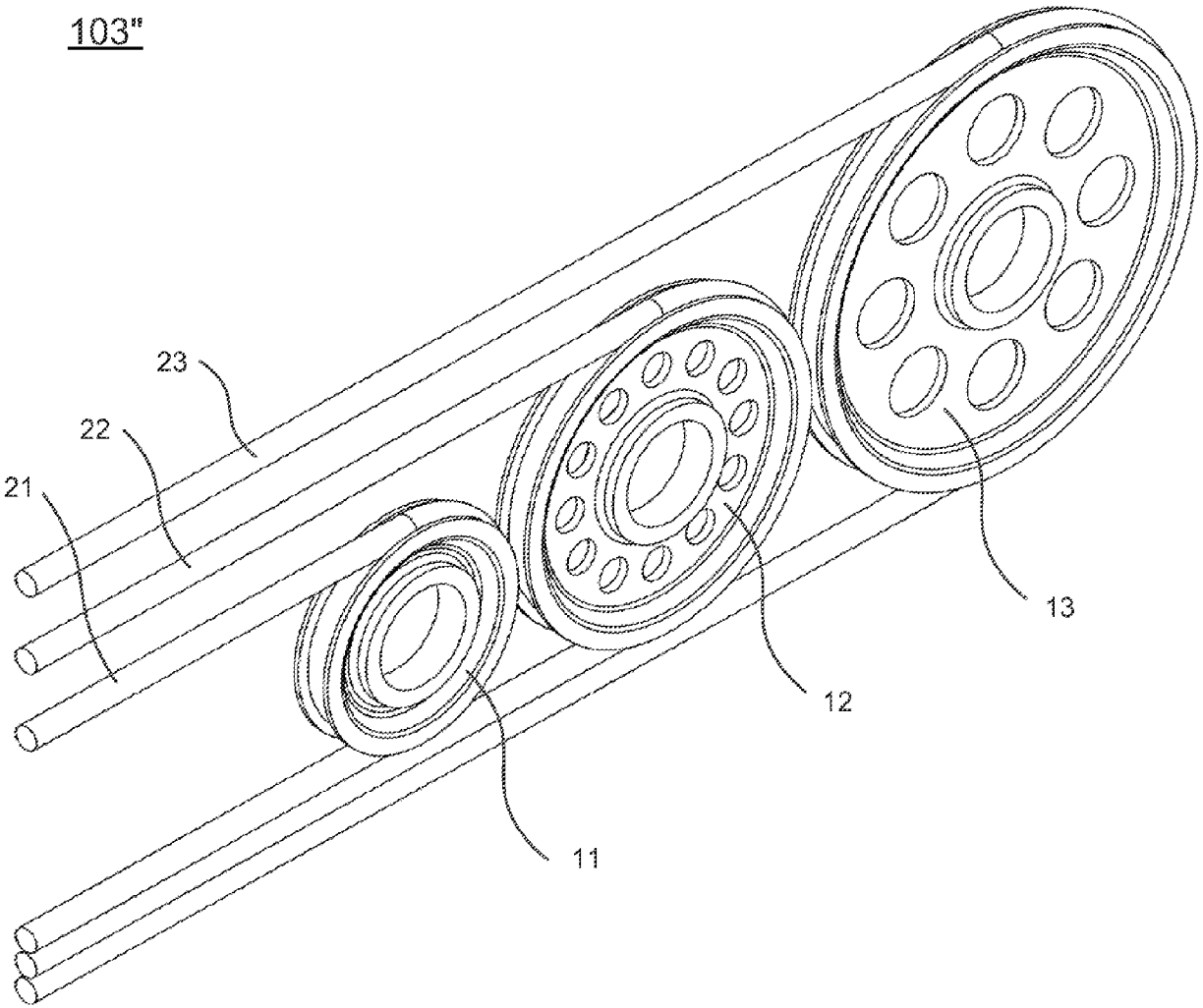

Referring now to FIGS. 4A-4C, a rear view, a side view and a perspective view of one of the two sheave assembly sets of the sheave assembly are respectively shown according to a second embodiment of the invention. Generally, the two sheave assembly sets of the sheave assembly are the same. For the simplicity of the description, only one sheave assembly set of the sheave assembly is illustrated and denoted with a reference numeral 103" hereinafter. Similar to the sheave assembly set 103' shown in FIGS. 3A-3C, the sheave assembly set 103" also has three sheaves 11, 12 and 13, and three cables 21, 22 and 23, and the three sheaves 11, 12 and 13 are arranged in a coplanar manner. Therefore, the majority of the description of FIGS. 3A through 3C will not be repeated herewith. The description of FIGS. 4A through 4C will focus on the differences of the sheave assembly set 103' of the first embodiment and the sheave assembly set 103" of the second embodiment. The differences lie how the three sheaves 11, 12 and 13 are arranged. In this exemplary embodiment, the third sheave 13 is placed near a head end 108A of the fourth boom section 108. The third cable 23 winds over the third sheave 13. The second sheave 12 is placed adjacent to the third sheave 13 with the center line of the second sheave 12 below the center line of the third sheave 13 such that the second cable 22 wound on the second sheave 12 has sufficient clearance and will not interfere with the movement of the third cable 23. The first sheave 11 is placed adjacent to the second sheave 12 with the center line of the first sheave 11 below the center line of the second sheave 12 such that the first cable 21 wound on the first sheave 11 has sufficient clearance and will not interfere with the movement of the second cable 22. The center lines of the three sheaves 11, 12 and 13 are not aligned in a straight line that is parallel to the lengthwise direction of the boon section 108. For example, the center line of the first sheave 11 is lower than that of the second sheave 12, which in turn is lower than that of third sheave 13. The arrangement of the first sheave 11, the second sheave 12, and the third sheave 13 can vary in other embodiments of the invention as well.

In a telescopic boom, several boom sections are used and connected to one another to form the telescopic boom. In the exemplary embodiment shown in FIG. 1, the telescopic boom 100 includes the first boom section 102, the second boom section 104, the third boom section 106, the fourth boom section 108 and the fifth boom section 110. Each of the five boom sections 102, 104, 106, 108 and 110 has a head end (102A, 104A, 106A, 108A or 110A), and an opposite, tail end, where only the tail end 102B of the first boom section 102 is shown in FIG. 1. As assembled, the tail end of the fifth boom section 110 is placed inside of the fourth boom section 108. The tail end of the fourth boom section 108 is placed inside of the third boom section 106. The tail end of the third boom section 106 is placed inside of the second boom section 104. The tail end of the second boom section 104 is placed inside of the first boom section 102.

In one embodiment, each of the five boom sections 102, 104, 106, 108 and 110 can be individually extended and retracted. In another embodiment, these five boom sections 102, 104, 106, 108 and 110 can be extended and retracted synchronously.

Figure 6A:
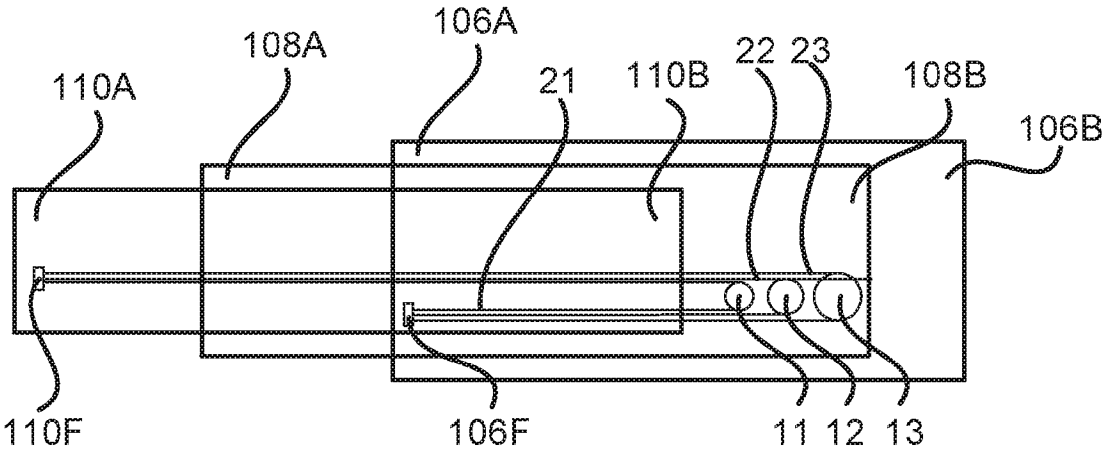
FIG. 6A and FIG. 6B schematically show a side view of a pulley assembly and certain boom sections according to one embodiment of the present invention.
Figure 6B:
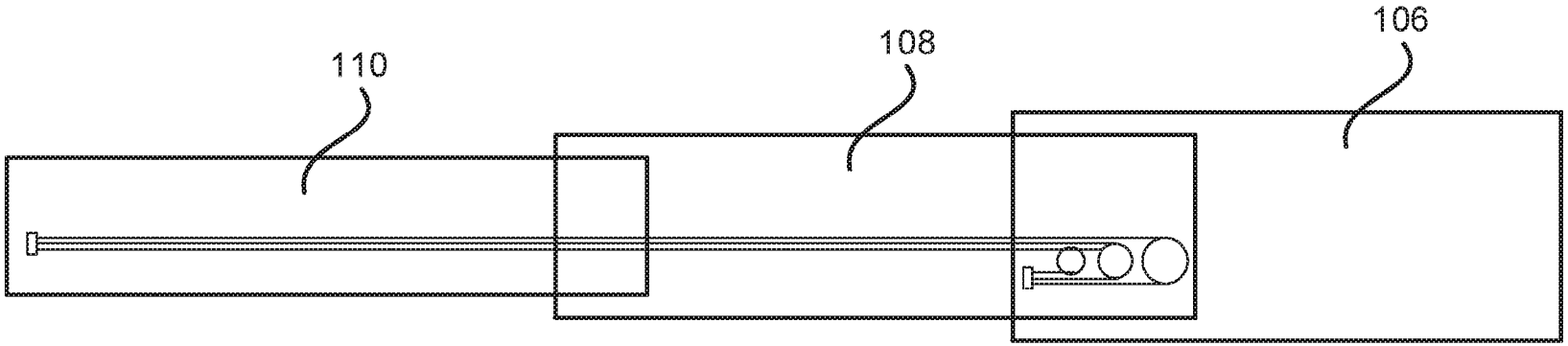

In order to facilitate movements of the boom sections, a sheave assembly 103 is placed between any two adjacent boom sections. In one embodiment, the sheave assembly 103 includes two sheave assembly sets 103A and 103B, as shown in FIG. 2. each sheave assembly set 103A or 103B is placed in a space defined between an outer sidewall of the fifth boom section 110 and a corresponding inner sidewall of the fourth boom section 108, and mounted on the corresponding inner sidewall of the fourth boom section 108. As such, the fifth boom section 110 can move (extend and retract) inside of the fourth boom section 108. When these two boom sections 108 and 110 are in a retracted state, the fifth boom section 110 stays inside of the fourth boom section 108. The first cable 21, the second cable 22 and the third cable 23 wind over the first sheave 11, and the second sheave 12, and the third sheave 13, respectively, as shown in FIGS. 3B and 4B. Each of the first cable 21, the second cable 22, and third cable 23 has a first end and a second end. The length of the cables 21, 22 and 23 inside of the fourth boom section 108 is about twice as the length of the fifth boom section 110. The first ends of the first cable 21, the second cable 22, and third cable 23 are fixed near the end of the fifth boom section 110. The second ends of the first cable 21, the second cable 22 and third cable 23 are fixed near the bottom end of the third boom section 106. The sheaves 11, 12 and 13 over which the cables 21, 22 and 23 run are fixed to the fourth boom section 108. When an internal hydraulic cylinder pushes on the fourth boom section 108 so as to cause it to move, the first fixed ends of the cables 21, 22 and 23 also move. This is due to the fact that the second ends are fixed to the third boom section 106. With the second ends fixed, when the sheaves 11, 12 and 13 move, the first ends of the cables 21, 22 and 23 are forced to move outward due to the movement of the sheaves 11, 12 and 13, thus causing the fifth boom section 110 to extend. FIG. 6A and FIG. 6B schematically show one example of the moving of the pulley assembly and certain boom sections. As shown in FIG. 6A, the pulley assembly includes the first sheave 11, the second sheave 12, and the third sheave 13 that are mounted on the second end 108B of the fourth boom section 108. The first cable 21, the second cable 22, and the third cable 23 respectively wind the first sheave 11, the second sheave 12, and the third sheave 13. The first ends of the first cable 21, the second cable 22, and third cable 23 are fixed to a first fixture 110F near the first end 110A of the fifth boom section 110. The second ends of the first cable 21, the second cable 22 and third cable 23 are fixed to the second fixture 106F near the first end 106A of the third boom section 106. The boom sections 108 and 110 are in a retracted state, the fifth boom section 110 stays inside the fourth boom section 108. When an internal hydraulic cylinder pushes on the fourth boom section 108 so as to cause it to move, as shown in FIG. 6B, the first fixed ends of the cables 21, 22 and 23 also move outward, thus causing the fifth boom section 110 to extend.

In this exemplary embodiment, the sheave assembly 103 is used for supporting the cables 21, 22 and 23. Telescopic actions of the telescopic boom are implemented by moving the cables 21, 22 and 23 synchronously. Moreover, considering the load requirements and the installation space, the telescopic boom in the embodiment takes advantage of a longitudinal space between adjacent boom sections 110 and 108 of the telescopic boom 100, i.e., a space along the lengthwise direction of the fourth boom section 108. Accordingly, the widthwise space between the adjacent boom sections 110 and 108 occupied by the sheaves 11, 12 and 13 in a horizontal direction is reduced, while the number of the cables is increased to three.

Specifically, to ensure the number of the cables, the sheave assembly 103 includes multiple sheaves. In order to reduce the occupied space of the boom sections in the widthwise direction, the multiple sheaves are disposed abreast along the lengthwise direction of the fourth boom section 108. Moreover, in order to prevent occurrence of winding or interference between adjacent cables 21, 22 and 23, the sheaves 11, 12 and 13 are disposed along the lengthwise direction of the fourth boom section 108 with the diameters of the sheaves 11, 12 and 13 successively increasing. Once the sheave assembly 103 is disposed in the foregoing manner, the surface linear velocities of the cables 21, 22 and 23 winding around the sheaves 11, 12 and 13, respectively, are the same, since the linear velocity of each of the cables 21, 22 and 23 is fixed. In other words, the linear velocity of each of the cables 21, 22 and 23 is the same when each of the cables 21, 22 and 23 passes through the sheaves 11, 12 and 13, respectively. Therefore, when these cables 21, 22 and 23 pass through the sheaves, no relative displacement exists among the cables 21, 22 and 23, and synchronous extension and refraction are implemented. In certain embodiments, the cables 21, 22 and 23 can be a steel cable, or a fiber cable such as a high-molecular-weight fiber cable.

In addition, to further prevent occurrence of friction among the cables 21, 22 and 23 winding on different sheaves 11, 12, and 23, respectively, the sheaves 11, 12 and 13 are adapted such that diameter difference between any two adjacent sheaves is not less than twice the diameter of the cables 21, 22 and 23, assuming the diameters of the cables 21, 22 and 23 are the same. If the diameters of the cables 21, 22 and 23 are not the same, then the sheaves 11, 12 and 13 are adapted such that diameter difference between any two adjacent sheaves is not less than twice the diameter of the thickest cable among the cables 21, 22 and 23. This is to ensure there is sufficient clearance among the cables 21, 22 and 23. It should be appreciated by persons skilled in the art that, the foregoing-mentioned diameter of a sheave is the diameter of the internal circle of the sheave around which the cables 21, 22 and 23 are wound. In one embodiment, the differences between the diameters of the any two adjacent sheaves in the sheave assembly 103 of the telescopic boom 100 are preferably equal. In another embodiment, the differences between the diameters of the any two adjacent sheaves in the sheave assembly 103 of the telescopic boom 100 are not equal.

Accordingly, the telescopic boom provided in the present invention takes great advantage of lengthwise direction spaces between the boom sections, so that the number of the cables can be increased by adding sheaves along the lengthwise direction of the boom sections. As such, a widthwise direction space between the boom sections occupied by the sheaves can be reduced, and particularly when all the sheaves are located on the same plane, the occupied widthwise direction space is only as thick as that of a sheave, thereby reducing the width dimension requirement of the telescopic boom. On the other hand, the number of cables can be adjusted according to the number of sheaves, thereby ensuring a loading capacity of the cables.

In another aspect, the present invention relates to an engineering machinery. In one embodiment, the engineering machinery is a crane. The engineering machinery includes the telescopic boom as disclosed above. Since the embodiments of the telescopic boom have the foregoing technical effects, the engineering machinery provided with the telescopic boom should also have corresponding technical effects. A specific implementation process of the engineering machinery is similar to that of the telescopic boom in accordance with the foregoing embodiments, and is not described herein again.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the invention pertains without departing from its spirit and scope. Accordingly, the scope of the invention is defined by the appended claims rather than the foregoing description and the exemplary embodiments described therein.

What is claimed is:

1. A telescopic boom, comprising a plurality of boom sections; and a pulley assembly, disposed between two adjacent boom sections of the plurality of boom sections, wherein the pulley assembly comprises three sheaves having different diameters and at least three cables, the three sheaves are mounted on one of the boom sections, and are arranged abreast along a lengthwise direction of the adjacent boom sections, the diameters of the plurality of sheaves increase successively along the lengthwise direction of the adjacent boom sections, wherein each of the at least three cables runs over one of the sheaves, such that each sheave is wound with at least one of the at least three cables; and wherein each of the at least three cables has a first end and an opposite second end, wherein the first end of each cable is fixed to one of the boom sections, and the second end of each cable is fixed to another one of the boom sections, such that the moving of the sheaves of the pulley assembly enables movement of the one of the boom sections relative to the another one of the boom sections.

2. The telescopic boom according to claim 1, wherein the at least three cables have same diameters.

3. A telescopic boom, comprising:

a plurality of boom sections, slidably connected to each other; and a pulley assembly, disposed between two adjacent boom sections, wherein the pulley assembly comprises a plurality of sheaves having different diameters and a plurality of cables, the plurality of sheaves is mounted on one of the boom sections, and is arranged abreast along a lengthwise direction of the adjacent boom sections, the diameters of the plurality of sheaves increase successively along the lengthwise direction of the adjacent boom sections, and a straight line passing centers of the sheaves are parallel to the lengthwise direction of the adjacent boom sections;

wherein each of the cables runs over one of the sheaves, such that each sheave is wound with at least one of the cables; and wherein each of the cables has a first end and an opposite second end, wherein the first end of each cable is fixed to one of the boom sections, and the second end of each cable is fixed to another one of the boom sections, such that the moving of the sheaves of the pulley assembly enables movement of the one of the boom sections relative to the another one of the boom sections.

4. The telescopic boom according to claim 3, wherein each sheave has at least one slot around which the at least one of the cables wind.

5. The telescopic boom according to claim 3, wherein the cables have same diameters.

6. The telescopic boom according to claim 3, wherein the cables have different diameters.

7. The telescopic boom according to claim 3, wherein diameter differences between any two adjacent sheaves in the pulley assembly are not less than twice a diameter of the thickest cable among the cables of the adjacent sheaves.

8. The telescopic boom according to claim 3, wherein diameter differences between any two adjacent sheaves in the pulley assembly are not equal.

9. The telescopic boom according to claim 3, wherein diameter differences between any two adjacent sheaves in the pulley assembly are equal.

* * * * *